United States Patent [19]

Ozu

[11] Patent Number: 4,702,088

[45] Date of Patent: Oct. 27, 1987

[54] COMPRESSOR FOR REVERSIBLE REFRIGERATION CYCLE

[75] Inventor: Masao Ozu, Fuji, Japan

[73] Assignee: Kabushiki Kaisha Toshiba, Kawasaki, Japan

[21] Appl. No.: 879,051

[22] Filed: Jun. 26, 1986

[30] Foreign Application Priority Data

Jun. 29, 1985 [JP] Japan ..... 60-143723

[51] Int. Cl.[4] ..... F25B 13/00

[52] U.S. Cl. ..... 62/324.1; 62/324.6; 62/508; 137/625.43

[58] Field of Search ..... 62/160, 324.1, 324.6, 62/324.7, 508; 137/625.43

[56] References Cited

U.S. PATENT DOCUMENTS 4,619,118 10/1986 Chu et al. ..... 62/324.6

FOREIGN PATENT DOCUMENTS 55-15012 5/1976 Japan .

59-63391 4/1984 Japan .

*Primary Examiner*—Lloyd L. King

*Attorney, Agent, or Firm*—Cushman, Darby & Cushman

[57] ABSTRACT

A compressor for a reversible refrigeration cycle is connected to indoor and outdoor heat exchangers through first and second refrigerant pipes. The compressor includes a closed casing defining an accumulation chamber therein. A compression section having a compression chamber is disposed in the casing so that a refrigerant is compressed in the compression chamber and then discharged into the accumulation chamber. A valve mechanism is disposed in the compression section and has a slider. The slider is arranged to be movable between a first position where the first and second refrigerant pipes are connected to the compression chamber and the accumulation chamber, respectively, and a second position where the first and second refrigerant pipes are connected to the accumulation chamber and the compression chamber, respectively. The slider is shifted to the first or second position by the pressure of the refrigerant.

9 Claims, 10 Drawing Figures

COMPRESSOR FOR REVERSIBLE REFRIGERATION CYCLE

BACKGROUND OF THE INVENTION

The present invention relates to a compressor, and more specifically to a compressor used in a reversible refrigeration cycle, such as an air conditioning system of a heat-pump type, which can shift its operation between cooling and heating modes.

In general, reversible refrigeration cycles, such as air conditioning systems of a heat-pump type, which can be shifted between cooling and heating operations, comprise a compressor, a four-way valve, an outdoor heat exchanger, an expansion valve as a pressure reducing device, and an indoor heat exchanger. These components are connected by means of refrigerant pipes to form a closed cycle. Those compressors conventionally used in small-capacity air conditioners for home use, for example, are rotary compressors which are small-sized and high in rotating efficiency.

As the compressor is rotated, a refrigerant is compressed and discharged into the refrigerant pipes. In a cooling mode, the refrigerant delivered from the compressor is returned thereto successively through the four-way valve, outdoor heat exchanger, expansion valve, indoor heat exchanger, and again the four-way valve. In a heating mode, the four-way valve is shifted so that the refrigerant discharged from the compressor is returned thereto via the four-way valve, indoor heat exchanger, expansion valve, outdoor heat exchanger, and again the four-way valve.

In both cooling and heating modes, the rotating direction of the compressor is fixed, so that the refrigerant is discharged always in a predetermined direction. The operation mode is switched by shifting the direction of the refrigerant flow in the four-way valve. Generally, the four-way valve comprises a valve body, a pilot valve in the body, and a solenoid for operating the pilot valve. Thus complicated in construction, it is very liable to malfunction or is low in reliability, and costs high. Since the valve body is connected with the respective ends of four refrigerant pipes, a wide space is required for the pipe arrangement, and the pipe connection is troublesome. The switching of the four-way valve requires a relatively large driving force, and therefore use of a large-sized solenoid. In this case, power consumption increases, so that the operating cost of the air conditioning system also increases. During the switching operation, moreover, the valve mechanism and refrigerant produce noises.

Thus, the four-way valve is expected to be replaced by some other means of switching the flowing direction of the refrigerant which is simpler in construction, higher in reliability, and more attractive in cost.

SUMMARY OF THE INVENTION

The present invention has been conceived in consideration of these circumstances, and is intended to provide a compressor for a reversible refrigeration cycle, capable of shifting the direction of discharge of the refrigerant, improved in reliability, and permitting a reduction in cost.

In order to achieve the above object, a compressor according to the invention comprises a closed casing defining an accumulation chamber therein; a compression section disposed in the casing and including a compression chamber, whereby the refrigerant is compressed in the compression chamber and then discharged into the accumulation chamber; a drive section disposed in the casing, for driving the compression section; a valve mechanism including a slider provided in the compression section so as to be movable between a first position where a first refrigerant pipe connecting with an indoor heat exchanger of a reversible refrigerating cycle and a second refrigerant pipe connecting with an outdoor heat exchanger are connected to the compression chamber and the accumulation chamber, respectively, and a second position where the first and second refrigerant pipes are connected to the accumulation chamber and the compression chamber, respectively, so that the refrigerant is sucked from the first refrigerant pipe into the compression section and then discharged into the second refrigerant pipe when the slider is in the first position, and that the refrigerant is sucked from the second refrigerant pipe into the compression section and then discharged into the first refrigerant pipe when the slider is in the second position; and a shift mechanism for moving the slider to change the direction of discharge of the refrigerant.

BRIEF DESCRIPTION OF THE DRAWINGS

FIGS. 1 to 5 show a compressor according to a first embodiment of the present invention, in which FIG. 1 is a plan view of a reversible refrigeration cycle including the compressor, FIG. 2 is a cutaway side view showing the interior of the compressor, FIG. 3 is an exploded perspective view of a compression section, FIG. 4 is a sectional view showing the principal part of the compression section, and FIG. 5 is a sectional view taken along line V—V of FIG. 2.

DETAILED DESCRIPTION OF THE PREFERRED EMBODIMENTS

Preferred embodiments of the present invention will now be described in detail with reference to the accompanying drawings.

Figure 1:
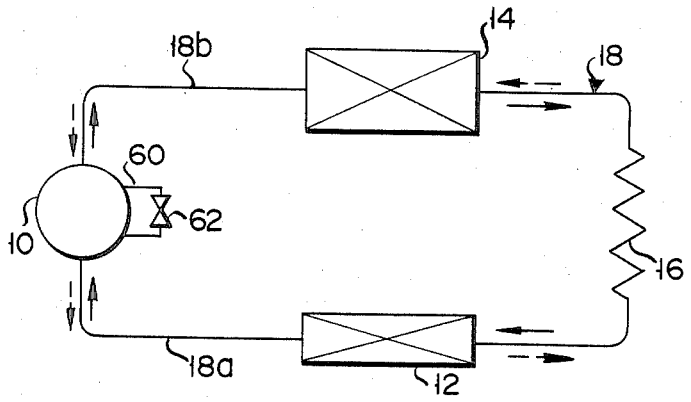

FIG. 1 shows a reversible refrigeration cycle of a so-called heat-pump type which is provided with compressor 10 according to the invention. The refrigeration cycle comprises compressor 10, indoor heat exchanger 12 and outdoor heat exchanger 14 connected to the compressor, and capillary tube 16 as a pressure reducing device connected between the heat exchangers. All these components are connected by means of refrigerant pipe 18. That portion of pipe 18 connecting compressor 10 and indoor heat exchanger 12 is referred to as first refrigerant pipe 18*a*, and that portion connecting compressor 10 and outdoor heat exchanger 14 as second refrigerant pipe 18*b*.

Figure 2:
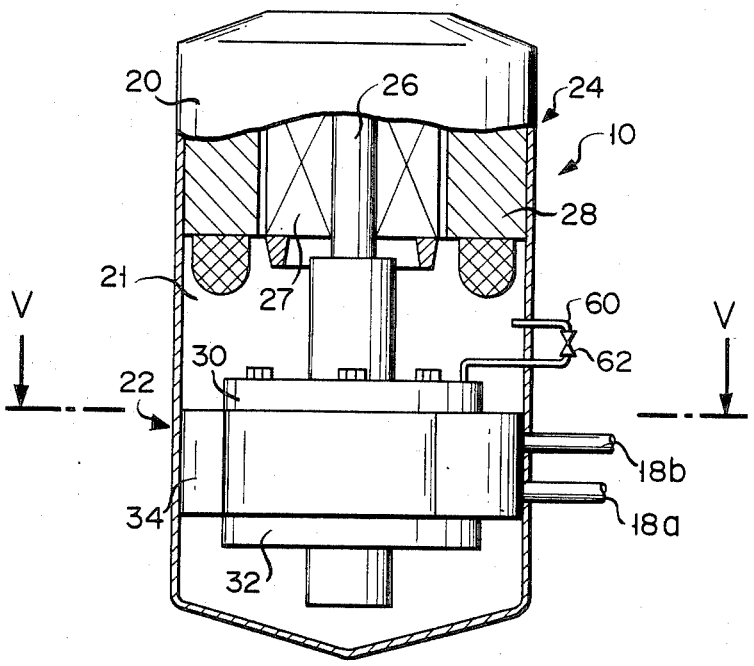
Figure 3:
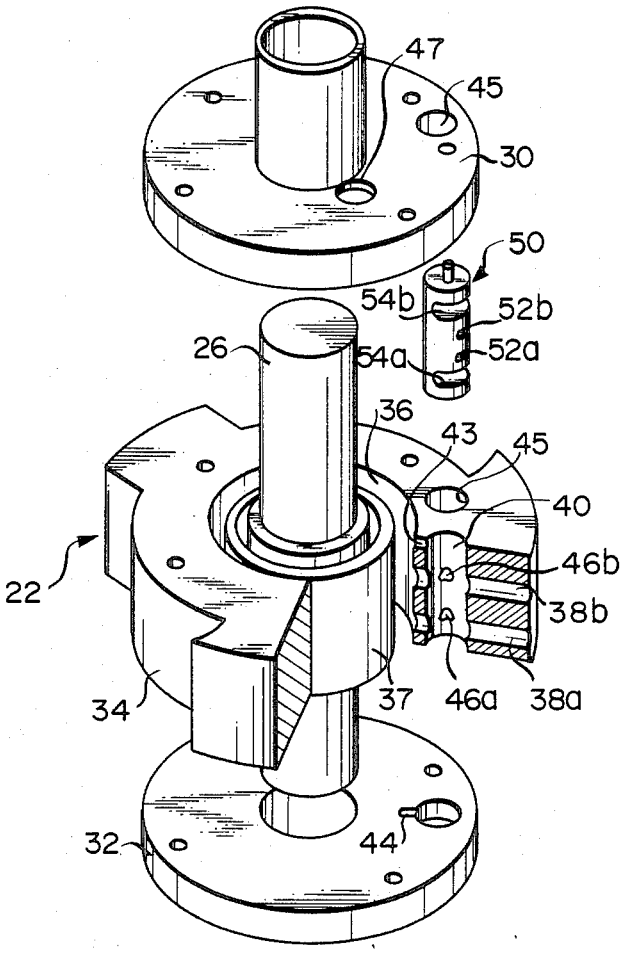

As shown in FIGS. 2 and 3, compressor 10 is a rotary compressor which includes closed casing 20 defining accumulation chamber 21 therein. Compression section 22 is provided in the lower portion of casing 20, while drive section 24, for driving the compression section, is disposed in the upper portion. Section 24 includes rotating shaft 26 vertically extending in casing 20, rotor 27 fixed on the upper end portion of the shaft, and stator 28 located outside the rotor and fixed to the inner surface of the casing. Compression section 22 includes main bearing 30 and auxiliary bearing 32 spaced in the axial direction of shaft 26 and rotatably supporting the lower end portion of the shaft, and cylinder 34 disposed between the two bearings. Cylinder 34 is fixed to the inner surface of casing 20 so as to be coaxial with rotating shaft 26. Bearings 30 and 32 and the inner surface of cylinder 34 define compression chamber 36. In chamber 36 are disposed an eccentric cam 26*a* (shown in FIG. 4) of shaft 26 and cylindrical roller 37 fitted around the cam. Roller 37 is eccentrically rotated by shaft 26 and cam 26*a* in the chamber.

Figure 4:
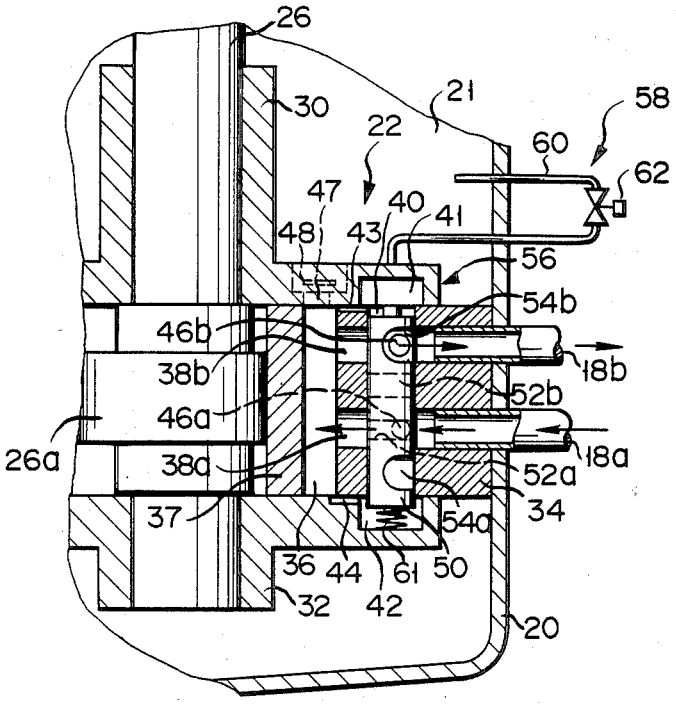
Figure 5:
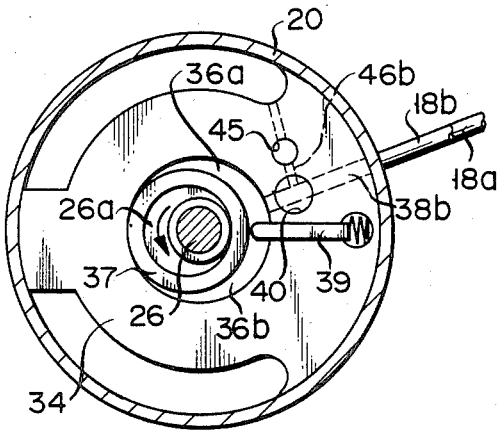

As shown in FIGS. 3 to 5, first and second inlet holes 38*a* and 38*b* are bored through the peripheral wall of cylinder 34, radially extending parallel to each other. Compression chamber 36 is divided into low-pressure chamber 36*a* and high-pressure chamber 36*b* by a blade 39 which elastically contacts with the outer periphery of roller 37. One end of each inlet hole opens into low-pressure chamber 36*a* of compression chamber 36, and the other end to the outside of casing 20. First and second refrigerant pipes 18*a* and 18*b* are connected to holes 38*a* and 38*b*, respectively. Guide holes 40 are bored through cylinder 34, extending in the axial direction of the cylinder so as to intersect holes 38*a* and 38*b*. A depression to serve a first pressure chamber 41 is formed in main bearing 30, which is located on the upper end side of hole 40. The first pressure chamber connects with guide hole 40. Likewise, a depression which serves as a second pressure chamber 42 is formed in auxiliary bearing 32 which is located on the lower end side of hole 40. The second pressure chamber also connects with hole 40. Chamber 41 communicates with low-pressure chamber 36*a* of compression chamber 36 by means of first slit 43 which is formed in cylinder 34. Chamber 42 communicates with low-pressure chamber 36*a* by means of second slit 44 which is formed in bearing 32. Gas hole 45 is bored through cylinder 34 and bearing 30, spaced from and extending parallel to guide hole 40. It connects with hole 40 and first inlet hole 38*a* by means of first delivery hole 46*a* in cylinder 34, and with hole 40 and second inlet hole 38*b* by means of second delivery hole 46*b* in the cylinder. Main bearing 30 is formed with discharge port 47 which connects high-pressure chamber 36*b* of compression chamber 36 and accumulation chamber 21. Port 47 is provided with discharge valve 48 for opening and closing it.

Cylindrical slider 50 is axially slide-inserted in guide hole 40. It is prevented from rotating within hole 40 by a suitable means. First and second connecting holes 52*a* and 52*b* are bored through slider 50, spaced and extending at right angles to the axis of the slider. Also, the slider is formed with first and second slits 54*a* and 54*b* with a U-shaped section located outside holes 52*a* and 52*b*, respectively. When slider 50 is in a first position shown in FIG. 4, first refrigerant pipe 18*a* communicates with compression chamber 36 by means of first inlet hole 38*b* and first connecting hole 52*a*, while second refrigerant pipe 18*b* communicates with accumulation chamber 21 by means of second inlet hole 38*b*, second slit 54*b*, second delivery hole 46*b*, and gas hole 45. When slider 50 is moved to a second position where its upper end abuts against main bearing 30, pipe 18*a* communicates with accumulation chamber 21 by means of hole 38*a*, first slit 54*a*, first delivery hole 46*a*, and hole 45, while pipe 18*b* communicates with chamber 36 by means of hole 38*b* and second connecting hole 52*b*. Slider 50 and the various holes in compression section 22 constitute valve mechanism 56 of the present invention.

The position of slider 50 is shifted by means of shift mechanism 58. Mechanism 58 includes pressure pipe 60 for supplying a high-pressure refrigerant into first pressure chamber 41, compression spring 61 in second pressure chamber 42 for urging slider 50 upward or toward the second position, and solenoid valve 62 provided at the middle portion of the pressure pipe. Pipe 60 has two opposite ends which communicate individually with chamber 41 and accumulation chamber 21. The middle portion of pipe 60 is exposed from casing 20. When valve 62 is opened, the compressed refrigerant in accumulation chamber 21 is fed through pipe 60 into chamber 41. As a result, slider 50 is moved, against the urging force of spring 61, to the first position.

The operation of the reversible refrigeration cycle, constructed in this manner, will now be described.

First, in circulating the refrigerant in the direction indicated by full-line arrows in FIG. 1 for a cooling operation, compressor 10 is started with solenoid valve 62 open. In this case, the refrigerant flows through compressor 10, outdoor heat exchanger 14, capillary tube 16, and indoor heat exchanger 12 in the order named. When compressor 10 is driven, accumulation chamber 21 is filled with high-pressure refrigerant gas. A portion of the gas is fed into pressure chamber 41 via pressure pipe 60 and valve 62. Slider 50 is depressed against the urging force of compression spring 61 by the pressure of the refrigerant gas, and is held in the first position. Thus, first refrigerant pipe 18*a* communicates with compression chamber 36 through first inlet hole 38*a* and first connecting hole 52*a* of slider 50, so that the gas is sucked from pipe 18*a* into chamber 36. Then, the incoming gas is compressed in chamber 36 as roller 37 rotates in an eccentric manner, and is discharged into accumulation chamber 21 via discharge port 47 and discharge valve 48. When slider 50 is in the first position, second refrigerant pipe 18*b* communicates with accumulation chamber 21 by means of second delivery hole 46*b* and gas hole 45. Therefore, the refrigerant gas introduced into chamber 21 is then discharged into pipe 18*b* through holes 45 and 46*b*. Thus, the refrigeration cycle performs the cooling operation. When slider 50 is in the first position, moreover, that portion of second inlet hole 38*b* on the compression chamber side and first delivery hole 46*a* are closed by the slider, and second connecting hole 52*b*, and first slit 54*a* are closed by the inner surface of guide hole 40.

In circulating the refrigerant in the direction indicated by broken-line arrows in FIG. 1 for a heating operation, compressor 10 is started with solenoid valve 62 closed. In this case, the refrigerant flows through compressor 10, indoor heat exchanger 12, capillary tube 16, and outdoor heat exchanger 14 in the order named. When compressor 10 is driven, accumulation chamber 21 is filled with the high-pressure refrigerant gas. Since valve 62 is closed, however, the gas cannot be fed into first pressure chamber 41. The refrigerant gas collected in chamber 41 during the cooling operation is discharged into compression chamber 36 through first slit 43. Otherwise the gas runs from first and second inlet holes 38*a* and 38*b* into chamber 36 through a narrow gap between slider 50 and guide hole 40. Accordingly, slider 50 is moved up to the second position by the urging force of compression spring 61. As a result, second refrigerant pipe 18*b* communicates with chamber 36 by means of second inlet hole 38*b* and second connecting hole 52*b* of slider 50, so that the refrigerant gas is sucked from pipe 18*b* into chamber 36. The gas is compressed in chamber 36 and then discharged into chamber 21. First refrigerant pipe 18*a* communicates with chamber 21 by means of first slit 54*a*, first delivery hole 46*a*, and gas hole 45. Therefore, the high-pressure refrigerant gas discharged into accumulation chamber 21 is delivered to indoor heat exchanger 12 via holes 45 and 46*a*, slit 54*a*, and pipe 18*b*. Thus, the refrigeration cycle performs the heating operation. In this state, that portion of hole 38*a* on the compression chamber side and second delivery hole 46*b* are closed by slider 50, and first connecting hole 52*a*, and second slit 54 are closed by the inner surface of guide hole 40.

According to the refrigeration cycle constructed in this manner, compressor 10 is provided with valve mechanism 56 and shift mechanism 58, and the operation can be shifted between cooling mode and heating mode by only opening or closing valve 62 of the shift mechanism. It is therefore unnecessary to use the four-way valve and complicated pipe arrangement which have been required conventionally. Thus, the refrigeration cycle can be simplified in construction, and it is possible to prevent gas leak as well as sympathetic vibration or breakage of piping. In consequence, the reliability of the cycle is improved and its manufacturing cost can be reduced. Since valve mechanism 56 is contained in closed casing 20, refrigerant sounds or switching sounds produced at the time of shifting the valve mechanism will be muffled. Valve 62 can be controlled by means of a microcomputer which currently is used commonly in air conditioning systems, without requiring any substantial additional cost.

Figure 6:
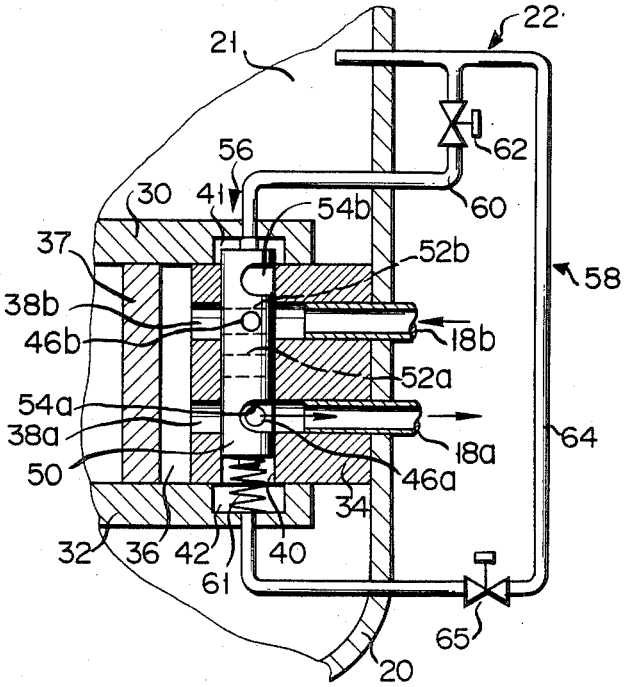
FIGS. 6 to 10 are sectional views showing compression sections of compressors according to second to sixth embodiments of the invention, respectively.

FIG. 6 shows compression section 22 of a compressor according to a second embodiment of the present invention. In FIG. 6, like reference numerals are used to designate like portions as described in connection with the first embodiment.

According to the second embodiment, shift mechanism 58 includes first pressure pipe 60 having two opposite ends connecting individually with accumulation chamber 21 and first pressure chamber 41, first solenoid valve 62 provided at the middle portion of pipe 60, second pressure pipe 64 having two opposite ends connecting individually with chamber 21 and second pressure chamber 42, second solenoid valve 65 provided at the middle portion of pipe 64, and compression spring 61 disposed in chamber 42.

In starting the heating operation, first and second valves 62 and 65 are closed and opened, respectively. A part of the high-pressure refrigerant gas compressed and discharged into accumulation chamber 21 is fed through second pressure pipe 64 into second pressure chamber 42. As a result, slider 50 is moved to the second position by the urging force of compression spring 61 and the pressure of the refrigerant gas. Accordingly, the individual holes of valve mechanism 56 are connected in the same manner as in the first embodiment. In this state, the gas is sucked from second refrigerant pipe 18*b* into compression chamber 36, where it is compressed and then discharged into first refrigerant pipe 18*a*. In starting the cooling operation, on the other hand, first and second valves 62 and 65 are opened and closed, respectively. Thereupon, slider 50 is moved down, against the urging force of spring 61, to the first position by the refrigerant gas fed into first pressure chamber 41 through first pressure pipe 60. Thus, as in the case of the first embodiment, the gas is sucked from first refrigerant pipe 18*a* into chamber 36, where it is compressed and then discharged into pipe 18*b*.

According to the second embodiment described above, the same functions and effects of the first embodiment can be obtained. Also, the shifting of the slider position can be performed more securely and more smoothly. In this embodiment, spring 61 may be omitted.

Figure 7:
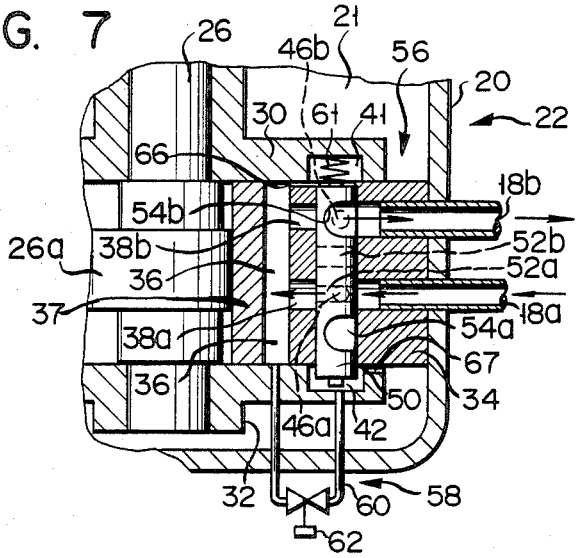

FIG. 7 shows a compression section of a compressor according to a third embodiment of the present invention.

In the third embodiment, first pressure chamber 41 communicates with compression chamber 36 through first slit 66, and second pressure chamber 42 with accumulation chamber 21 by means of second slit 67. Shift mechanism 58 includes pressure pipe 60 having two opposite ends connecting individually with chambers 42 and 36, solenoid valve 62 provided at the middle portion of pipe 60, and compression spring 61 disposed in chamber 41 and urging slider 50 toward the first position.

In starting the cooling operation, compressor 10 is actuated with valve 62 open. As a result, second pressure chamber 42, which connects with compression chamber 36 through pressure pipe 60, becomes the low-pressure side, so that slider 50 is moved to the first position, urged by compression spring 61. In starting the heating operation, compressor 10 is actuated with valve 62 closed. Accordingly, a part of the high-pressure refrigerant gas in accumulation chamber 21 is fed into chamber 42 via second slit 67. As a result, chamber 42 becomes the high-pressure side, so that slider 50 is moved, against the urging force of spring 61, to the second position. Thus, the heating operation is performed in the same manner as in the first embodiment.

Figure 8:
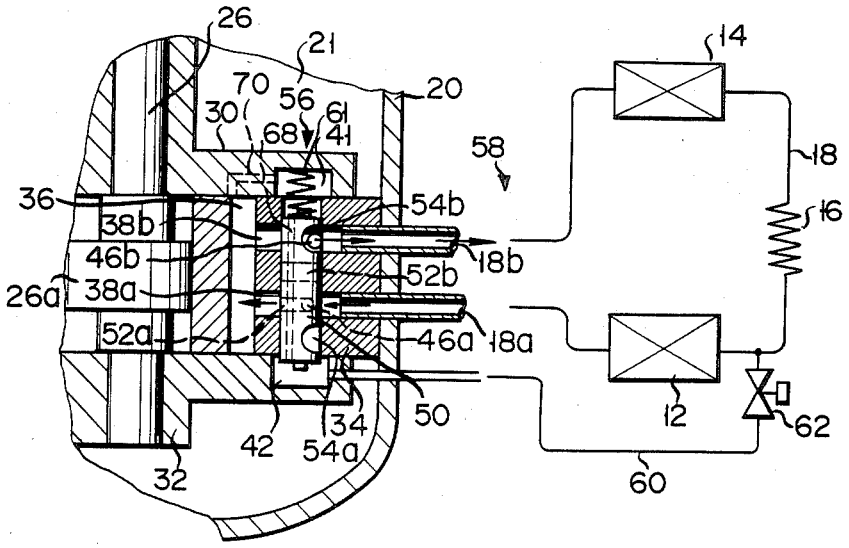

FIG. 8 shows a compressor according to a fourth embodiment of the present invention.

In the fourth embodiment, gas passage 68 is bored through slider 50 in its axial direction. It is formed so as to intersect none of first and second connecting holes 52*a* and 52*b* and first and second slits 54*a* and 54*b*. Main bearing 30 is formed with connecting passage 70 which connects first pressure chamber 41 and high-pressure chamber 36*b* of compression chamber 36. Shift mechanism 58 includes pressure pipe 60, solenoid valve 62 provided at the middle portion of pipe 60, and compression spring 61 disposed in chamber 41 and urging slider 50 toward the first position. One end of pipe 60 communicates with second pressure chamber 42, while the other end connects with refrigerant pipe 18 between indoor heat exchanger 12 and capillary tube 16.

In starting the cooling operation, valve 62 is closed. As a result, slider 50 is moved to the first position by the urging force of spring 61, and the direction of discharge of the refrigerant is changed in the same manner as in the foregoing embodiments. In starting the heating operation, compressor 10 is actuated with valve 62 open. As a result, a portion of the high-pressure liquid refrigerant discharged from indoor heat exchanger 12 is fed through pressure pipe 60 into second pressure chamber 42, so that slider 50 is moved, against the urging force of compression spring 61, to the second position. Accordingly, the refrigerant is sucked from second refrigerant pipe 18*b* into chamber 36, compressed, and then discharged into first refrigerant pipe 18*a*. Meanwhile, a portion of the liquid refrigerant fed into chamber 42 is introduced into first pressure chamber 41 via gas passage 68, and then into high-pressure chamber 36*b* of chamber 36 through connecting passage 70. Thus, the refrigerant gas being compressed in chamber 36 is cooled by the liquid refrigerant, thereby increasing the amount of the refrigerant supplied to the indoor heat exchanger. Thus, heating capability of the refrigerating cycle can be improved.

Figure 9:
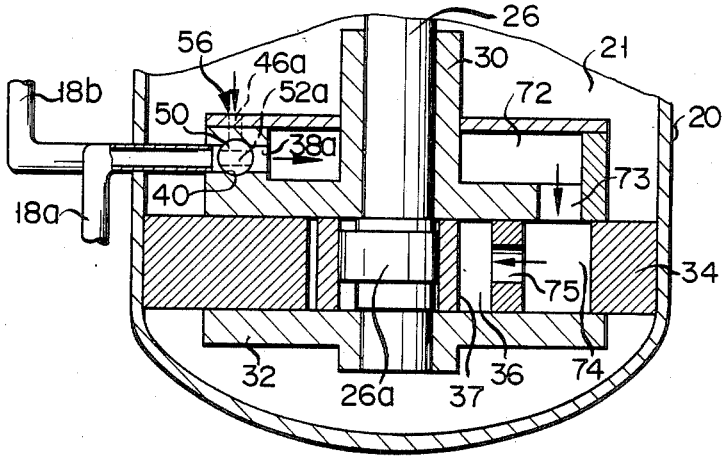

In the several embodiments described above, slider 50 is disposed in cylinder 34 for movement in the axial direction of rotating shaft 26. As shown in FIG. 9, however, it may alternatively be arranged in main bearing 30 so as to be movable at right angles to shaft 26 or in the horizontal direction. The construction of valve mechanism 56 may be just the same as that in the foregoing embodiments. According to this fifth embodiment, low-pressure muffler chamber 72 is defined in bearing 30, and first and second inlet holes 38*a* and 38*b* (only 38*a* shown in FIG. 9) connect with chamber 72. Also, the muffler chamber communicates with compression chamber 36 by means of gas passage holes 73, 74 and 75 which are formed in bearing 30 and cylinder 34. The shift mechanism exactly resembles that of the foregoing embodiments in construction. In the cooling operation, the refrigerant gas is sucked from first refrigerant pipe 18*a* into chamber 72, and introduced into chamber 36 through holes 73, 74 and 75. The high-pressure gas delivered to accumulation chamber 21 is discharged into second refrigerant pipe 18*b* via delivery hole 46*a*. It is to be understood that the refrigerant gas flows in the opposite direction in the heating operation.

Figure 10:
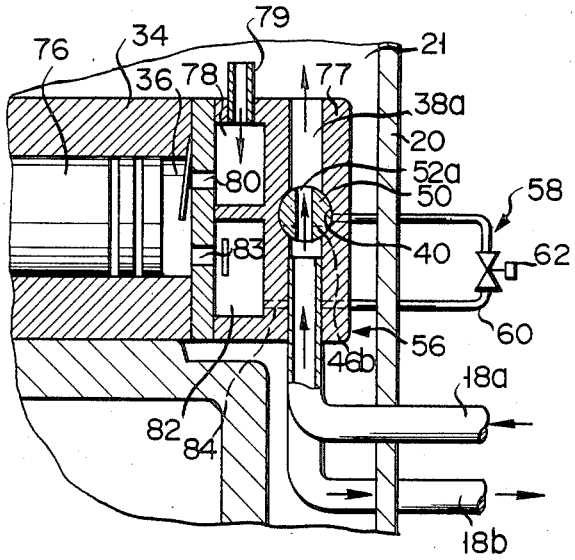

FIG. 10 shows a sixth embodiment of the present invention applied to a reciprocating compressor. In this embodiment, piston 76 is inserted in cylinder 34, and valve mechanism 56 is provided in cylinder head 77. First and second inlet holes 38*a* and 38*b* (only 38*a* shown) formed in head 77 connect with accumulation chamber 21. Suction chamber 78 is defined in head 77. It connects with chamber 21 and compression chamber 36 by means of inlet pipe 79 and inlet port 80, respectively. Also, discharge chamber 82 is defined in head 77. It connects with chamber 36 by means of delivery port 83 and with guide hole 40 by means of first and second delivery holes 46*a* and 46*b* (only one shown). Slider 50 is inserted in hole 40. One end of pressure pipe 60 of shift mechanism 58 connects with a first pressure chamber (not shown), while the other end communicates with chamber 82 by means of pressure port 84 in cylinder head 77.

In starting the cooling operation, when solenoid valve 62 is opened, the refrigerant gas is sucked from first refrigerant pipe 18*a* into chamber 21 through first inlet hole 38*a*. Then, the gas is fed into compression chamber 36 via inlet pipe 79, suction chamber 78, and inlet port 80, and compressed by piston 76. The compressed refrigerant gas is discharged into discharge chamber 82 through delivery port 83, and then into second refrigerant pipe 18*b* through delivery hole 46*b* and a slit (not shown) in slider 50. In starting the heating operation, when valve 62 is closed, the refrigerant gas is sucked from pipe 18*b* into chamber 36, compressed, and then discharged into pipe 18*a*.

It is to be understood that the present invention is not limited to the embodiments described above, and that various changes and modifications may be effected therein by one skilled in the art without departing from the scope or spirit of the invention. For example, the invention may be applied to scroll compressors, as well as rotary and reciprocating compressors.

What is claimed is:

1. A compressor for a reversible refrigeration cycle which is connected to an indoor heat exchanger and an outdoor heat exchanger of the refrigeration cycle by means of first and second refrigerant pipes, respectively, whereby a refrigerant is sucked from either of the refrigerant pipes, compressed, and then discharged into the other refrigerant pipe, comprising:

a closed casing defining an accumulation chamber therein;

a compression section disposed in the casing and including a compression chamber, for compressing the refrigerant in the compression chamber and then discharging it into the accumulation chamber;

a drive section disposed in the casing, for driving the compression section;

a valve mechanism including a slider provided in the compression section to be movable between a first position where the first and second refrigerant pipes are connected to the compression chamber and the accumulation chamber, respectively, and a second position where the first and second refrigerant pipes are connected to the accumulation chamber and the compression chamber, respectively, so that the refrigerant is sucked from the first refrigerant pipe into the compression chamber and then discharged into the second refrigerant pipe when the slider is in the first position, and that the refrigerant is sucked from the second refrigerant pipe into the compression chamber and then discharged into the first refrigerant pipe when the slider is in the second position, a first inlet hole formed in the compression section and having one end opening into the compression chamber and the other end connecting said the first refrigerant pipe, a second inlet hole formed in the compression chamber and the other end connecting with the second refrigerant pipe, a guide hole formed in the compression section so as to intersect the first and second inlet holes, a first delivery hole formed in the compression section and having one end connecting with the first inlet hole through the guide hole and the other end connecting with the accumulation chamber, and a second delivery hole formed in the compression section and having one end connecting with the second inlet hole through the guide hole and the other end connecting with the accumulation chamber;

said slider being slidably inserted in the guide hole and including a first connecting hole adapted to connect with the first inlet hole when the slider is in the first position, a second connecting hole adapted to connect with the second inlet hole when the slider is in the second position, a first slit for connecting the first delivery hole and the first refrigerant pipe when the slider is in the second position, and a second slit for connecting the second delivery hole and the second refrigerant pipe when the slider is in the first position; and a shift mechanism for moving the slider to change the direction of discharge of the refrigerant.

2. The compressor according to claim 1, wherein said casing includes a muffler chamber defined in the compression section and communicating with the compression chamber, and said first and second inlet holes communicate with the compression chamber through the muffler chamber.

3. The compressor according to claim 1, wherein said valve mechanism includes first and second pressure chambers defined in the compression section and a guide holes formed in the compression section and having two opposite ends connecting individually with the first and second pressure chambers, said slider is inserted in the guide hole for axial slide, and said shift mechanism includes pressurizing means for feeding the refrigerant at high pressure into one of the pressure chambers so that the slider is moved by the difference in pressure between the two chambers.

4. The compressor according to claim 3, wherein said pressurizing means includes a pressure pipe having one end connecting with said one pressure chamber and the other end connecting with the accumulation chamber and valve means provided in the pressure pipe for opening and closing it, and said shift mechanism includes an urging member disposed in said other pressure chamber to urge the slider toward said one pressure chamber.

5. The compressor according to claim 3, wherein said pressurizing means includes a first pressure pipe having two opposite ends connecting individually with said one pressure chamber and the accumulation chamber, first valve means disposed in the first pressure pipe to open and close the same, a second pressure pipe having two opposite ends connecting individually with said other pressure chamber and the accumulation chamber, and second valve means disposed in the second pressure pipe to open and close the same.

6. The compressor according to claim 3, wherein said pressurizing means includes a high-pressure-side slit connecting said one pressure chamber and the accumulation chamber, a pressure pipe having two opposite ends connecting individually with said one pressure chamber and the compression chamber, and valve means disposed in the pressure pipe to open and close the same, and said shift mechanism includes an urging member disposed in said other pressure chamber to urge the slider toward said one pressure chamber.

7. The compressor according to claim 3, wherein said pressurizing means includes a pressure pipe having one end connecting with said one pressure chamber and the other end connected to the high-pressure side of the refrigeration cycle, and valve means disposed in the pressure pipe to open and close the same, and said shift mechanism includes an urging member disposed in said other pressure chamber to urge the slider toward said one pressure chamber.

8. The compressor according to claim 7, wherein said shift mechanism includes feed means for feeding into the compression chamber a portion of the refrigerant fed through the pressure pipe into said one pressure chamber.

9. The compressor according to claim 8, wherein said feed means includes a first passage formed in the slider to connect the first and second pressure chambers, and a second passage formed in the compression section to connect said other pressure chamber and the compression chamber.

* * * * *